US005340402A

United States Patent [19]

Beisswanger

[11] Patent Number: 5,340,402

[45] Date of Patent: Aug. 23, 1994

[54] NOZZLE APPLICATOR FOR APPLICATION OF COATING COLOR ON A PAPER WEB

[75] Inventor: Rudolf Beisswanger, Steinheim, Fed. Rep. of Germany

[73] Assignee: J.M. Voith GmbH, Heidenheim, Fed. Rep. of Germany

[21] Appl. No.: 18,737

[22] Filed: Feb. 17, 1993

[30] Foreign Application Priority Data

Feb. 21, 1992 [DE] Fed. Rep. of Germany ..... 4205313

[51] Int. Cl.[5] ..... B05C 3/18

[52] U.S. Cl. ..... 118/410; 118/419; 118/50; 427/294

[58] Field of Search ..... 118/50, 58, 68, 410, 118/419; 427/294

[56] References Cited

U.S. PATENT DOCUMENTS 4,738,877 4/1988 Krautzberger ..... 417/356
4,880,671 11/1989 Sollinger et al. ..... 427/356
4,995,399 2/1991 Tobisawa et al. ..... 118/410

*Primary Examiner*—Michael W. Ball
*Assistant Examiner*—Francis J. Lorin
*Attorney, Agent, or Firm*—Baker & Daniels

[57] ABSTRACT

A coating system for application of coating color on a paper web. A roll is wrapped by the paper web, and a nozzle feeds coating color to the paper web. The nozzle includes an overflow slat, a dosing slat, and an application zone. The application zone is preceded by a slat extending across the web width and forming with the paper web a gap space extending in the direction of web travel. The slat features an edge which is located at the entrance of the paper web to the gap space. The slat features an air guide surface which starts at the edge, scrapes off the air film clinging to the paper web and deflects it away from it. The slat further features an air guide channel starting at the gap space and ending in the area of the air guide surface.

6 Claims, 3 Drawing Sheets

NOZZLE APPLICATOR FOR APPLICATION OF COATING COLOR ON A PAPER WEB

BACKGROUND OF THE INVENTION

The invention concerns a coater for application of coating color on a paper web.

Coaters of this general type are known in numerous variants, e.g.;

(1) DE 37 15 154
(2) DE 38 25 412
(3) DE 36 09 383
(4) DE 41 33 501

Problems are encountered with such nozzle applicators especially in the wedge-shaped entrance zone between applicator roll and backing roll, and particularly at high speeds. This is attributable most of all to the effect of air which is carried into the entrance gore along with the paper web as the backing roll rotates. The air mixes with the coating color at the point where the latter makes contact with the paper web. Occurring generally at the upper edge of the machinewide overflow slat is a crossing of the overflow stream, and at that, opposite to the travel direction of the paper web and opposite to the airflow. If the airflow impinges on this overflow stream, this results in a partial backup of the overflow stream and in the mixing of air and coating color.

It would be desirable for the paper web and coating color to form a straight line of contact with each other as they meet. Due to the illustrated effects of the air carried in, however, the line of contact is not straight, but frequently tongue-shaped. If there are permanent air inclusions which remain across the entire coating zone, the paper web is not wetted at all by coating color at the respective points, and thus remains uncoated at these spots. This is highly undesirable.

The problem underlying the present invention is to fashion a nozzle applicator so that the disturbing air inclusions in the entrance gore will be avoided. Specifically, the line of contact where the paper web and coating color stream meet is to be a straight line. Air inclusions are to be avoided at any rate.

SUMMARY OF THE INVENTION

This problem is solved by the inventive features of the present invention. In one aspect thereof, the invention comprises a coater for application of coating color on a paper web. The coater includes a roll wrapped around by the paper web. Extending across the width of the web is a nozzle for feeding coating color to the paper web, with an overflow slat located on the entrance side of the paper web, a dosing slat located on the exit side of the paper web, and an application zone enclosed between the two. The application zone is preceded by a slat extending across the web width and forming with the paper web a gap space extending in the direction of web travel. The slat features an edge located at the entrance of the paper web to the gap space, and an air guide surface which—viewed as a side elevation—starts at the edge and scrapes the air film off the paper web and deflects it away from it. The slat features at least one air guide channel which starts at the gap space and ends in the area of the air guide surface, downstream of the edge.

A basic idea is constituted by subjecting the gap space extending in the direction of web travel to suction, so that any air present there will be removed. The airflow itself carried by the paper web is utilized for unfolding an ejector effect so that it evacuates the air guide channel—and thus also the gap space. The air is thus removed completely automatically, without requiring any special means. The stronger the airflow is that is carried along with the paper web, the greater the evacuation.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates two preferred embodiments of the invention, and such exemplification is not to be construed as limiting the scope of the invention in any manner.

DETAILED DESCRIPTION OF THE INVENTION

Figure 1:
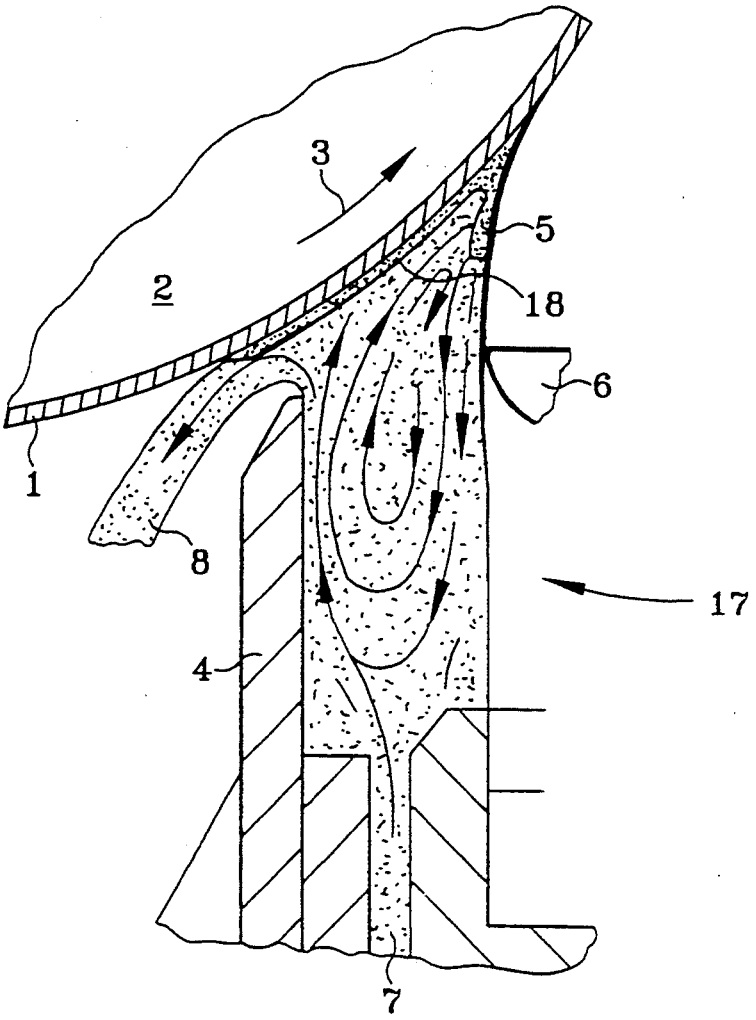
Fig. 1 PRIOR ART
FIG. 1 shows a side elevation of a nozzle applicator in a very general form.

The nozzle applicator illustrated in FIG. 1 serves the application of coating color on a paper web 1. The paper web wraps around a rotatably mounted roll 2 which rotates in the direction of arrow 3.

An essential component of the nozzle applicator is the nozzle itself, comprised of an overflow slat 4 located on the entrance side of the paper web, and of a dosing slat 5 located on the exit side of the paper web. The two slats enclose between themselves the actual zone of application. The dosing slat 5—presently fashioned as a flexible doctor blade—can be forced more or less heavily on the coated paper web 1 by means of a thrust slat 6.

The nozzle 17 has an inlet 7 through which the coating color is fed at surplus to the interior of the nozzle. The surplus flows across the upper edge of the overflow slat 4 as a stream 8. The direction of flow is essentially opposite to the direction of travel of the paper web 1.

Clinging to the paper web is an air film which, depending on the speed of rotation of the roll 2, is entrained by the paper web 1. This air film proceeds into the wedge-shaped gore between the paper web and the overflow stream 8. Part of the air film continues to cling to the paper web and proceeds into the application zone 18, thereby preventing a complete coating of the paper web with coating color. The finished coated paper contains voids, where coating color is absent, which represents a serious lack of quality.

Figure 2:
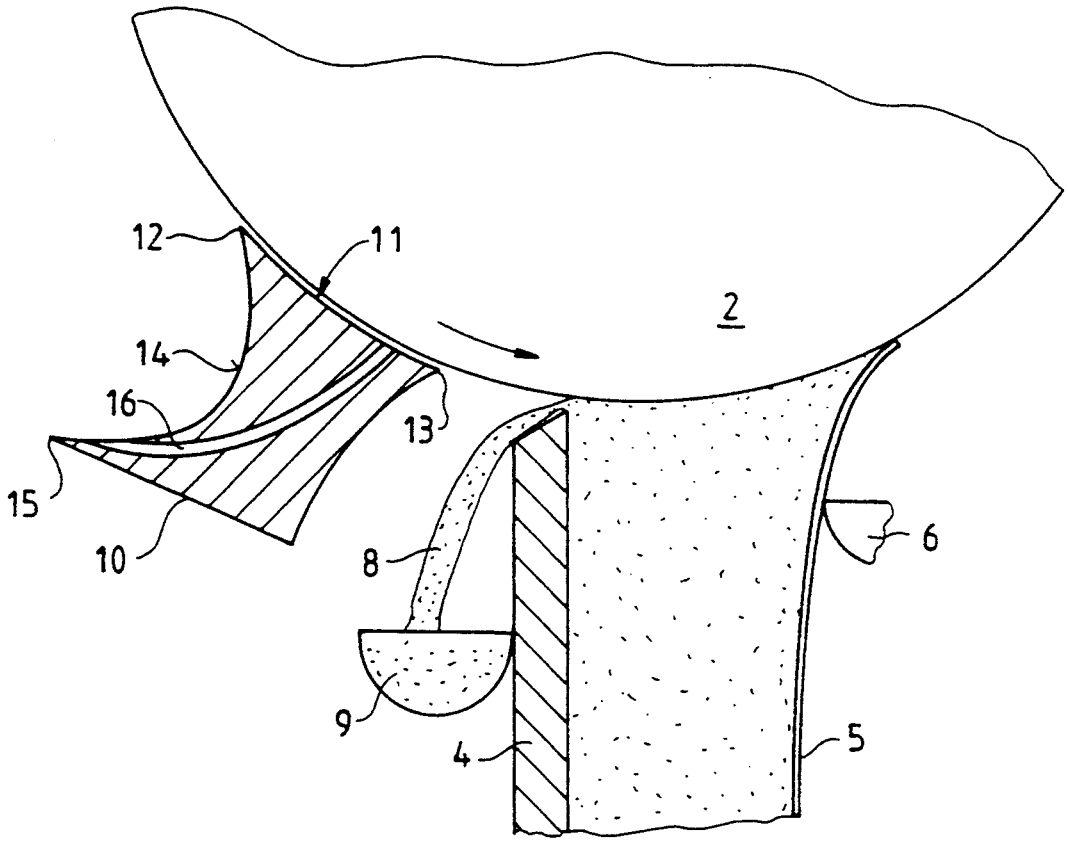
FIG. 2 shows a side elevation of a first embodiment of an applicator according to the invention.
Figure 3:
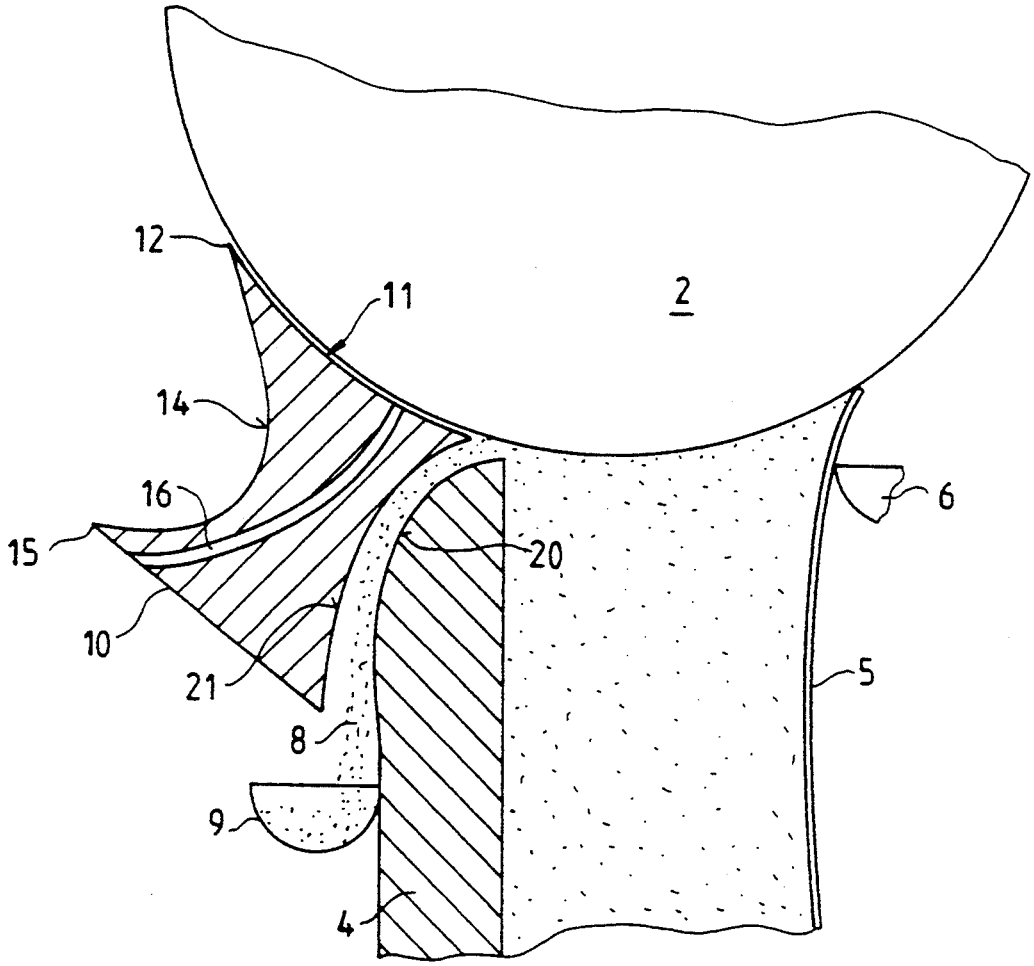
FIG. 3 shows a side elevation of a second embodiment of an applicator according to the invention.

FIGS. 2 and 3 show essentially the same elements of the nozzle applicator according to in FIG. 1, including an overflow slat 4, dosing slat 5, and a thrust slat 6. The overflow stream 8 proceeds into a chute 9 which carries it away.

In the embodiment according to FIG. 2, the application zone—that is, the area between the overflow slat 4 and the dosing slat 5—is preceded by slat 10, which embodies the invention proper. This slat 10 extends across the width of the paper web and forms together with the paper web 1 a gap space 11. Thus, the gap space 11 extends in the one direction as well as across the web width, in the other direction—direction of travel of the paper web 1—from an entrance edge 12 of the slat 10 to an exit edge 13 of this slat 10.

Slat 10 features an air guide surface 14 having a concave shape and extending from the entrance edge 12 up to a terminal edge 15. Additionally, the slat 10 features a number of bores, or channels, 16. These are distributed across the entire length of the slat 10, and thus across the width of the web.

This nozzle applicator works as follows: The air film carried along by the paper web impinges on the entrance edge 12 of the slat 10. Most of the air film is scraped off the paper web 1 and deflected along the air guide surface 14. As can be seen, the channels 16 empty in the air guide surface 14. As the deflected air flows along the air guide surface 14, a suctioning of the air guide channels 16 is taking place, and at that, due to an ejector effect. The air guide channels 16 are thus evacuated more or less heavily.

The air film carried along by the paper web is not completely scraped off by the entrance edge 12 of the slat 10. A small part proceeds into the gap space 11, flowing there at first with the paper web 1 in the direction of rotation until reaching the inlet openings of the air guide channels 16. Due to the suction effect prevailing there, it enters the air guide channels 16 and, at the said mouths of which, is entrained at the air guide surface 14 by the air flowing there. Thus, the venting of the gap space 11 takes place in a nearly perfect manner. Downstream of the exit edge 13, though, the paper web is still in contact with the surrounding air. But the section between the exit edge 13 and the overflow slat 4 is too small for the paper web 1 to impart to this air film a velocity which still would be sufficient for the film to proceed into the application zone.

Thus, the slat 10 can by all means be arranged at a certain finite distance from the overflow slat 4. The closer the slat 10 is located at the overflow slat 4, the more effective is the invention. An especially favorable case is illustrated in FIG. 3. Here, the overflow slat 4 and the slat 10 have been set very close to each other. They may even be combined to a single component, or design unit. With the embodiment according to FIG. 3 there occurs additionally a particular synergistic effect: the deflection surface 20 of the dosing slat 4 forms together with the back surface 21 of the slat 10 a flow channel for the surplus stream 8.

Another variation from the embodiment according to FIG. 2 is constituted in that the air guide channels 16 do not empty in the air guide surface 14, but only in its vicinity, and at that, near the terminal edge 15. The airflow deflected by the air guide surface 14 exerts here an ejector effect on the mouths of the air guide channels 16, so that the desired effect is achieved. Alternatively, air guide channels 16 may be straight-line bores.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A coater for applying a color coating onto the surface of a travelling paper web, wherein the paper web wraps around a roll and has a direction of travel, said coater comprising:

a nozzle extending across the width of the web for feeding the color coating to the paper web, said nozzle including an overflow slat, a dosing slat, and an application zone enclosed between said overflow slat and said dosing slat, said overflow slat positioned on an entrance side of the nozzle wherein the web enters said application zone, and said dosing slat positioned on an exit side of the nozzle wherein the web exits said application zone; and an air slat preceding said application zone along the direction of web travel, said air slat extending across the web width and defining with said web a gap space extending in said direction of web travel, said air slat including an edge located at an entrance of said paper web to said gap space in the direction of travel of the web, said air slat further including an air guide surface which viewed in side elevation starts at said edge and is structured and arranged to scrape an air film from said web and deflect said film away from the web, said air slat further including at least one air guide channel, said air guide channel originating at said gap space and ending downstream of said edge at said air guide surface or in closely spaced relationship thereto.

2. The coater of claim 1, wherein said air guide channel empties into the air guide surface.

3. The coater of claim 1, wherein said air guide surface, viewed in side elevation, is concave outward toward the entrance of the gap.

4. The coater of claim 1, wherein said overflow slat and said air slat preceding said application zone comprise a design unit.

5. The coater of claim 4, wherein said overflow slat and said air slat preceding said application zone define a channel for draining a stream of surplus color coating flowing across a terminal edge of the overflow slat.

6. Coater for application of coating color on a paper web, with the following characteristics:

a roll wrapped around by the paper web;

extending across the web width, a nozzle for feeding coating color to the paper web, with an overflow slat located on the entrance side of the paper web, a dosing slat located on the exit side of the paper web, and an application zone enclosed between the two;

the improvement comprising:

the application zone is preceded by an air slat extending across the web width and forming with the paper web a gap space extending in the direction of web travel;

the air slat features an edge located at the entrance of the paper web to the gap space;

the air slat features an air guide surface which—viewed as a side elevation—starts at the edge and scrapes the air film off the paper web and deflects it away from the surface of the web;

the air slat includes at least one air guide channel which starts at the gap space and ends in the area of the air guide surface, downstream of the edge.

* * * * *